US005650809A

United States Patent [19]

Kitamura

[11] Patent Number: 5,650,809

[45] Date of Patent: Jul. 22, 1997

[54] IMAGE RECORDING APPARATUS HAVING APERTURE ELECTRODE WITH DUMMY ELECTRODES FOR APPLYING TONER IMAGE ONTO IMAGE RECEIVING SHEET

[75] Inventor: Tetsuya Kitamura, Gifu, Japan

[73] Assignee: Brother Kogyo Kabushiki Kaisha, Nagoya, Japan

[21] Appl. No.: 408,713

[22] Filed: Mar. 22, 1995

[30] Foreign Application Priority Data

Mar. 28, 1994 [JP] Japan ..... 6-056972

[51] Int. Cl.[6] ..... B41J 2/06

[52] U.S. Cl. ..... 347/55; 347/112; 347/141

[58] Field of Search ..... 347/111, 55, 112, 347/141, 151, 120, 123, 49, 50; 355/261, 262

[56] References Cited

U.S. PATENT DOCUMENTS

| | | | |
|---|---|---|---|
| 5,036,341 | 7/1991 | Larsson | 347/55 |
| 5,166,709 | 11/1992 | Kubelik | 347/151 |
| 5,374,949 | 12/1994 | Wada et al. | 347/151 |
| 5,404,155 | 4/1995 | Kitamura | 347/55 |
| 5,434,607 | 7/1995 | Keefe | 347/50 |

FOREIGN PATENT DOCUMENTS

| | | |
|---|---|---|
| 587 366 | 3/1994 | European Pat. Off. . |
| 57-185452 | 11/1982 | Japan . |
| 443370 | 2/1992 | Japan . |
| 4144756 | 5/1992 | Japan . |
| 6-24029 | 2/1994 | Japan . |

*Primary Examiner*—Benjamin R. Fuller
*Assistant Examiner*—Charlene Dickens
*Attorney, Agent, or Firm*—Oliff & Berridge

[57] ABSTRACT

An image recording apparatus having aperture electrode body formed with a plurality of apertures through which toners pass to deposit onto an image receiving member. The aperture electrode body includes an insulative substrate having the apertures and control electrodes formed over the insulative substrate and each surrounding each aperture. The aperture electrode body has a nature of bending due to difference in thermal expansion coefficient of the insulative substrate and the control electrodes. To provide uniform bending, dummy electrodes are formed over the insulative substrate. The dummy electrodes includes a first set of dummy electrodes positioned at upstream side of the control electrodes with respect to a running direction of the image receiving member. The dummy electrode also includes a second set of dummy electrodes positioned beside the extreme end of the control electrode in the array direction of the apertures.

24 Claims, 3 Drawing Sheets

IMAGE RECORDING APPARATUS HAVING APERTURE ELECTRODE WITH DUMMY ELECTRODES FOR APPLYING TONER IMAGE ONTO IMAGE RECEIVING SHEET

BACKGROUND OF THE INVENTION

The present invention relates to an image recording apparatus for use in copying machines, printers, and facsimiles, etc.

In the image recording apparatus of this kind, electric potential is applied to a selected one of the plurality of apertures of a toner flow control means such as an aperture electrode body in accordance with image data, so that the charged toners pass through the aperture to form a toner image onto an image receiving member running on an opposing electrode. More specifically, a toner supply unit such as a toner carrier roller is disposed below the aperture electrode body for transferring charged toners to the aperture electrode body, and the opposing electrode is provided above the aperture electrode body for directing the toners passing through the aperture toward the image receiving member. The aperture electrode body includes an insulative substrate made of polyimide in which a plurality of apertures are formed and electrically conductive control electrodes formed of copper which are positioned on the insulative substrate for surrounding respective apertures.

However, such a conventional image recording apparatus, since the toners are firmly fixed to the outer peripheral surface of the toner carrier roller due to image force, and therefore, the toners are not smoothly introduced into the aperture electrodes, i.e., toner flow control by the toner flow control means cannot be sufficiently performed.

To avoid this problem, a laid open European Patent Application publication No. 587,366 discloses an image recording apparatus in which the aperture electrode body is in contact with the toner carrier roller at least at the area of apertures. Still however, another unsolved problem remains.

As shown in FIGS. 1 through 3, in the conventional image recording apparatus, particular areas of the insulative substrate of the aperture electrode body may be deformed due to difference in thermal expansion coefficient relative to the control electrodes. The particular area may be the area on which the control electrode is mounted. The aperture electrode body 71 shown in FIG. 1 includes an insulative substrate 72 and control electrodes 73. The insulative substrate 72 is formed with a plurality of apertures 74 arrayed in one direction and spaced away from each other by a constant distance, and each control electrode 73 surrounds each aperture 74. The insulative substrate 72 and the control electrodes are formed of polyimide and copper, respectively. Here, the thermal expansion coefficient of polyimide is $2.0\times10^{-5}$1/°C. whereas the thermal expansion coefficient of copper is $1.7\times10^{-5}$2/°C. Copper electrodes are formed on the polyimide substrate by sputtering or plating which require relatively high temperature. Therefore, after sputtering or plating, the shrinkage ratio of the polyimide is greater than that of the copper. As a result, the polyimide substrate is subjected to tensile stress whereas the copper electrodes are subjected to compressive stress in the room temperature.

Accordingly, the aperture electrode body 71 is arcuately deformed as shown in FIG. 2 in such a manner that the electrode body 71 is recessed at the side confronting the toner carrier roller 11. As a result, wrinkle-like inflection curve is generated at the boundary 77 of the control electrode 73 as shown in FIG. 2, where toner particles may be accumulated or deposited, to degrade toner supply to the aperture 74, to thus reduce imaging density.

Further, as shown in FIGS. 1 and 3, with respect to the direction of the array of the apertures 74, the aperture electrode providing portion (zone X) is recessedly deformed with respect to the surface of the toner carrier roller 11, whereas the aperture electrode non-providing portion (zone Y) is maintained flat. Therefore, the zone Y is in pressure contact with the toner carrier roller 11, whereas the zone X is floated over the roller 11. Consequently, at the boundary portion 78 between the zones X and Y, toners are forcibly supplied into the aperture 74 positioned at the extreme end of the aperture array. Accordingly, imaging density at the extreme portion becomes high, and fog may occur in the resultant image.

SUMMARY OF THE INVENTION

It is therefore, an object of the present invention to overcome the above described conventional disadvantages and drawbacks and to provide an improved image recording apparatus capable of eliminating unevenness of the output image and providing a stabilized image recordation in the image receiving member.

This and other objects of the present invention will be attained by an image recording apparatus for forming a toner image on an image receiving medium including toner flow control means, toner transferring means, control voltage application means and dummy electrodes. The toner flow control means has an insulative substrate in which a plurality of apertures are formed and control electrodes formed on the insulative substrate and each formed around each one of the apertures. The toner transferring means is adapted for transferring toners toward the apertures. The control voltage application means applies a predetermined controlled voltage to the control electrodes for allowing the toners to pass through the apertures. The dummy electrodes are provided on the toner flow control means. The dummy electrodes are provided on the insulative substrate at positions offset from the apertures.

In another aspect of the invention, there is provided an image recording apparatus for forming a toner image on an image receiving medium, the image receiving medium running in a running direction, the apparatus including toner flow control means having an insulative substrate in which a plurality of apertures are formed and control electrodes formed on the insulative substrate and each formed around each one of the apertures, the plurality of apertures being arrayed in a direction perpendicular to the running direction, toner transferring means for transferring toners toward the apertures, control voltage application means which applies a predetermined controlled voltage to the control electrodes for allowing the toners to pass through the apertures, and dummy electrodes provided on the toner flow control means. The dummy electrodes are provided on the insulative substrate at positions offset from the apertures. The dummy electrodes include a first set of dummy electrodes for adjusting internal stress in the toner flow control means, so that the toner flow control means can be continuously bent without any inflection point in a cross-section taken in the running direction. The dummy electrodes also include a second set of dummy electrodes for providing an inflection point at a position offset from the aperture but at the second set of dummy electrodes in a cross-section taken in the aperture array direction.

DETAILED DESCRIPTION OF THE PREFERRED EMBODIMENTS

Figure 1:
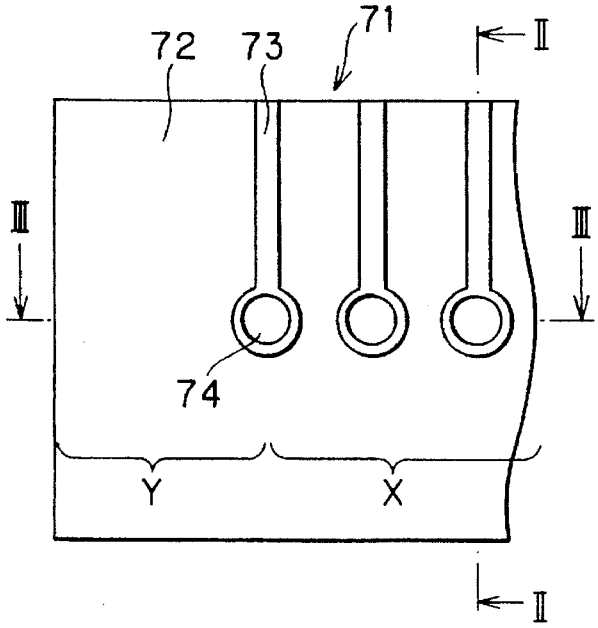
FIG. 1 PRIOR ART
FIG. 1 is an enlarged plan view showing a part of a conventional aperture electrode body.

An image recording apparatus according to a first embodiment of the present invention will be described with reference to FIGS. 4 through 7.

The apparatus includes a chassis 26 having a sheet inlet 21 and a sheet outlet 22 for inserting and discharging an image receiving member P. Within the chassis 26, there are provided an aperture electrode body 1 serving as toner flow control means, an opposing electrode 6 and a toner supplying unit 10.

Figure 5:
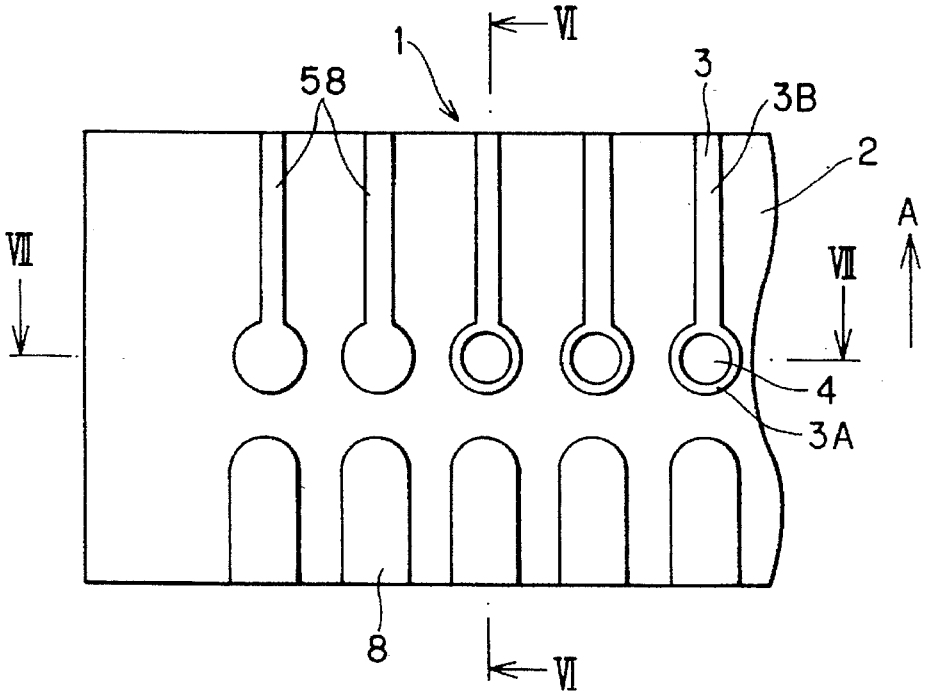
FIG. 5 is an enlarged plan view showing a part of an aperture electrode body according to the embodiment of the present invention.

The aperture electrode body 1 includes a plate like insulative substrate 2, and a plurality of apertures 4 are formed and arrayed in the longitudinal direction of the substrate 2 with a space equal to each other. Control electrodes 3 are provided on the insulative substrate 2 in such a manner that each of the control electrodes independently surrounds each one of the apertures 4 as shown in FIG. 5. Each of the control electrodes 3 has a circular portion 3A surrounding the aperture 4 and a liner portion 3B provided integrally with the circular portion and extending in the sheet running direction A. A combination of the control electrode 3 and the aperture 4 provides a control portion. Position of the control electrodes 3 is deviated toward downstream side with respect to the sheet running direction A in the substrate 2.

According to the present invention, as shown in FIG. 5, a first set of dummy electrode array 8 is provided at the upstream side in the substrate 2. Each dummy electrode 8 is positioned in alignment with each control electrode 3 in the sheet running direction A. Further, a second set of dummy electrodes 58 is positioned beside the endmost control electrode 3 with respect to the array direction of the control electrodes 3 with a space equal to the spacing of the control electrodes. Of course, the first dummy electrodes 8 are provided in alignment with the second set of dummy electrodes 58.

The insulative substrate 2 is formed of a polymer film, preferably polyimide, having a thickness of 25 micron meters. The control electrodes 3, the first set of dummy electrodes 8 and the second set of dummy electrodes 58 are made of an electrically conductive material such as a copper and have thickness of 8 micron meter.

A voltage applying circuit 5 is connected to the control electrodes 3 for applying potentials to each of the control electrodes 3. This circuit selectively applies toner passable voltage of +30 V and toner blocking voltage of −10 V to selected control electrodes 3 in accordance with image data. On the other hand, the dummy electrodes 8 and 58 are not applied with the voltage, but preferably are grounded.

Figure 4:
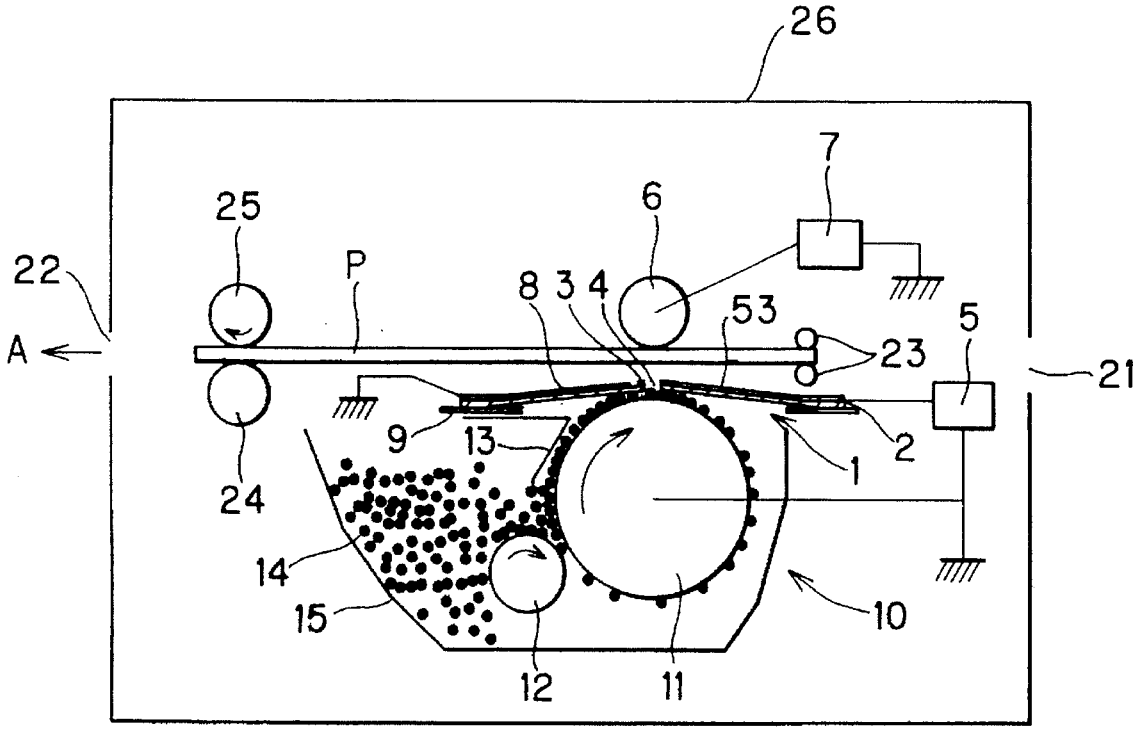
FIG. 4 is a schematic illustration showing an image recording apparatus according to a first embodiment of the present invention.

The toner supplying unit 10 is disposed below the aperture electrode body 1. The toner supplying unit 10 includes a toner case 15 for containing toners 14, a toner supply roller 12 rotatably disposed in the toner case 15, a toner carrier roller 11 and a blade 13. The toner case 15 has a top table formed with an opening to expose a part of the toner carrier roller 11. The toner supply roller 12 is positioned nearby the toner carrier roller 11 for supplying toners 14 to the toner carrier roller 11. The toner carrier roller 11 is adapted to rotatably carry the toners 14 and to transfer the toners to the aperture electrode body 1. The blade 13 is positioned in contact with the toner carrier roller 11 for scraping excessive toner from the surface of the toner carrier roller 11. A table 9 is disposed in the chassis 26 for supporting the aperture electrode body 1 at a position above the toner case 15. The aperture electrode body 1 is so supported that all apertures 4 are in contact with the top of the toner carrier roller 11. As best shown in FIG. 4, the control electrode 3 of the aperture electrode body 1 confronts the image receiving member P, while the insulative substrate 2 is in contact with the toner carrier roller 11 at positions of the apertures 4.

The opposing electrode 6 is positioned above the aperture electrode body 1. A space such as 0.5 mm is provided between the aperture electrode body 1 and the opposing electrode 6 for allowing the image receiving member P to pass through the space. A DC power source 7 is connected to the opposing electrode for applying +500 V thereto.

A pair of guide rollers 23 is positioned near the inlet 21 for introducing the inserted image receiving member P toward the portion below the opposing electrode 6. Further, a thermal fixing unit including a heat roller 24 and a press roller 25 is provided for thermally fixing toner image onto the image receiving member P.

In operation, by the rotation of the toner carrier roller 11 and the toner supply roller 12 in the direction indicated by arrows in FIG. 4, the toner 14 supplied from the toner supply roller 12 are rubbingly transferred onto the toner carrier roller 11, and the toners are negatively charged to be held on the toner carrier roller 11. The toner layer on the toner carrier roller 11 is scraped by the toner scraper blade 13, so that the toner layer becomes a thin layer, which is transferred toward the aperture electrode body 1.

Kinetic energy is imparted on the toners 14 carried on the toner carrier roller 11 due to the shearing force provided by the sliding force between the insulative substrate 2 of the aperture electrode body 1 and the toner carrier roller 11 before the toners reach the aperture 4 of the aperture electrode body 1. Because of the kinetic energy, the attractive force of the toners 14 to the toner carrier roller 11 is moderated or reduced, and therefore, the toners can be easily introduced into the apertures 4.

Figure 6:
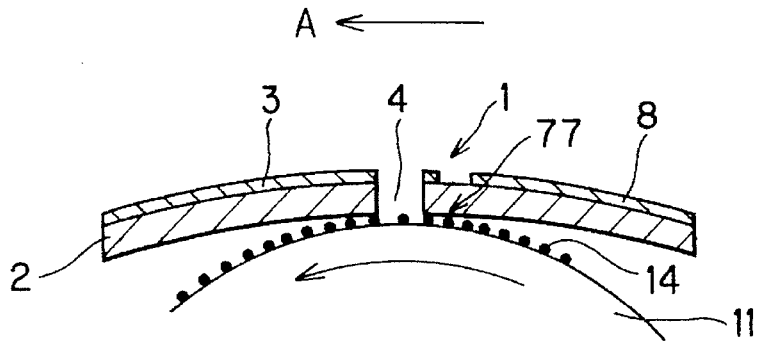
FIG. 6 is a cross-sectional view taken along the line VI—VI of FIG. 5.

The thermal expansion coefficients of polyimide which is the material of the insulative substrate 2 and the copper which is the material of the control electrodes 3 are $2.0\times10^{-5}$ and $1.7\times10^{-5}$ 1/°C., respectively as described above. Since the control electrode forming process such as sputtering and plating is performed at high temperature, shrinkage ratio of the polyimide is higher than that of the copper when restoring room temperature. Thus, the polyimide is subjected to tensile stress, whereas the copper is subjected to compressive stress. As a result, the aperture electrode body 1 is bent in a concave manner with respect to the toner carrier roller 11 as shown in FIG. 6.

Figure 2:
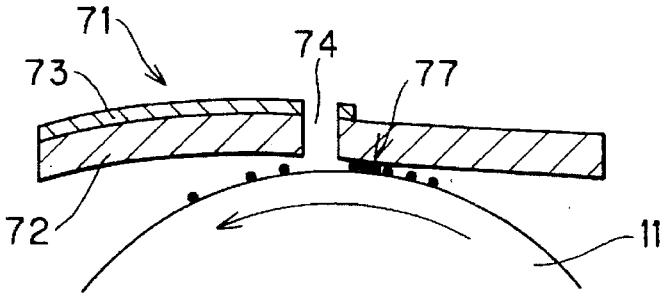
FIG. 2 PRIOR ART
FIG. 2 is a cross-sectional view taken along the line II—II of FIG. 1.
Figure 3:
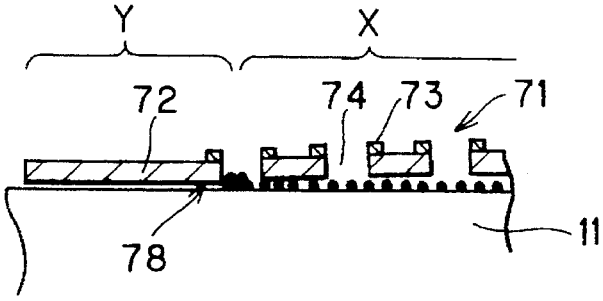
FIG. 3 PRIOR ART
FIG. 3 is a cross-sectional view taken along the line III—III of FIG. 1.

Here, in the conventional aperture electrode body, unwanted deformation is generated at the boundary portion 77 as shown in FIG. 2, which degrades toner transfer. On the other hand, in the illustrated embodiment, internal strain is also imparted onto the area where the first set of dummy electrodes 8 are provided. Therefore, continuous curvature can be provided in the aperture electrode body 1 without any inflection point. As a result, toner stagnation does not occur, and the toner can be smoothly transferred to the apertures 4 of the aperture electrode body 1. As a result, toner image density can be maintained.

Figure 7:
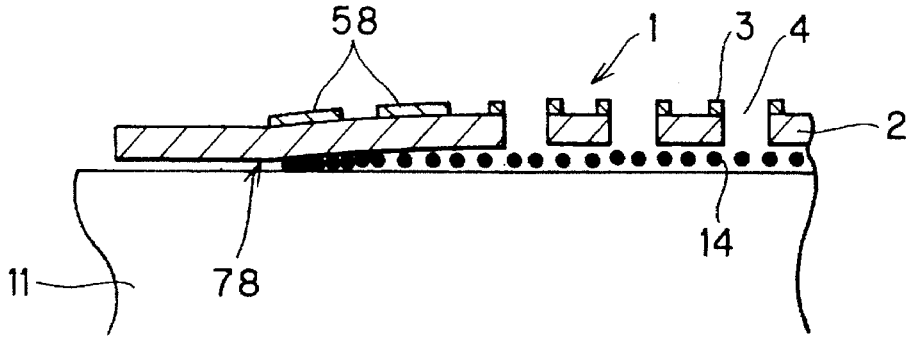
FIG. 7 is a cross-sectional view taken along the line VII—VII of FIG. 5.

Further, as shown in FIG. 7, the portion where the control electrodes 3 and the second set of dummy electrodes 58 are provided is bent in a concave fashion with respect to the toner carrier roller 11 due to the internal stress, whereas the extreme end portion (the lateral end portion with respect to the sheet running direction A) is maintained in flat. Therefore, the latter portion is in pressure contact with the toner carrier roller 11. Accordingly, toners are urged toward the boundary portion 78. However, the toners urged toward the boundary portion do not serve imaging because only the second set of dummy electrodes 58 are provided adjacent the boundary portion. In other words, the toners can be uniformly distributed over the all aperture portions 4. Consequently, toner density can be uniform in the direction of the aperture array. That is, formation of an extremely high density image or foggy image at the lateral side of the imaging section can be prevented.

In accordance with the image recording signal, +30 V is applied from the control voltage applying circuit 5 to the selected one of the control electrode 3. As a result, electric line of force directed from the control electrode 3 to the toner carrier roller 11 is generated because of the potentials between the control electrode 3 and the grounded toner carrier roller 11. Thus, the negatively charged toners 14 undergo electrostatic force toward the high potential side, so that the toners are flowed from the toner carrier roller 11 to the control electrode 3 through the aperture 4.

On the other hand, remaining one of the control electrodes 3 which corresponds to non-imaging area is applied with 31 10 voltage as toner blocking voltage from the control voltage applying circuit 5. As a result, an electric field is provided between the toner carrier roller 11 and the control electrode 3, to prevent the negatively charged toners from being flowed through the aperture 4.

Since the opposing electrode 6 is applied with +500 V, the electric field is provided between the aperture electrode body 1 and the opposing electrode 6. Therefore, the toners passing through the apertures 4 are attracted toward the opposing electrode 6. Further, since the image receiving member P is introduced toward the opposing electrode 6 by the guide rollers 23, the toner image is successively formed on the image receiving member P. The image carried or image receiving member P is fed toward the thermal fixing unit 24, 25 so that the toner image is thermally fixed to the image receiving member P. The image receiving member P is then discharged from the apparatus through the sheet outlet 22.

In the image recording apparatus according to the first embodiment of the present invention, as described above, lowering of the image density can be prevented, and further, it is possible to avoid formation of extremely high density image or fog at the lateral side of the imaging section because of the provision of the first and second sets of dummy electrodes 8 and 58.

Figure 8:
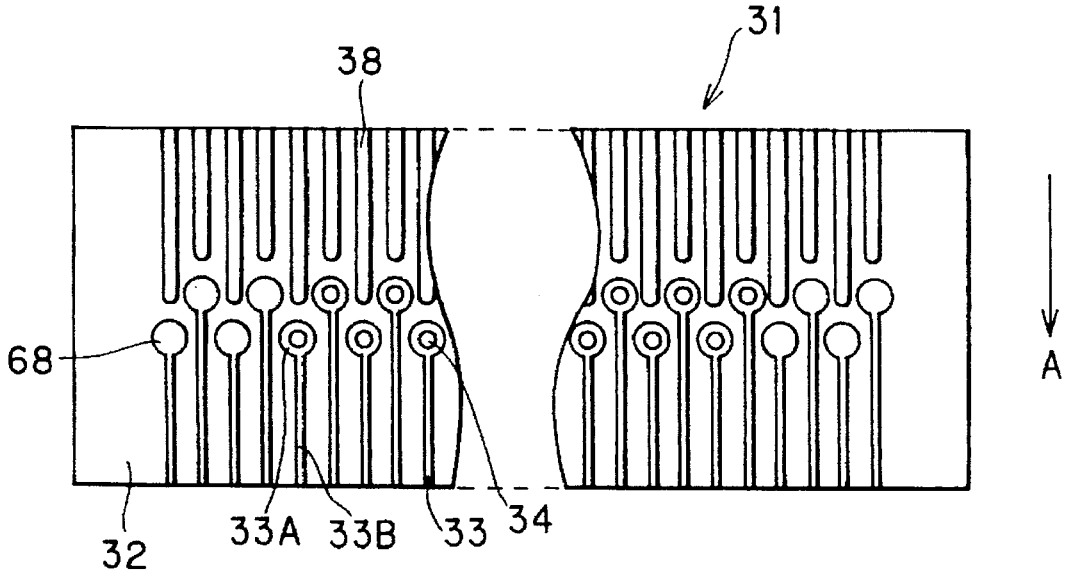
FIG. 8 is an enlarged plan view showing a part of an aperture electrode body according to a second embodiment of the present invention.

An image recording apparatus according to a second embodiment of the present invention will next be described with reference to FIG. 8. The second embodiment pertains to a modification of the aperture electrode body. The aperture electrode body 31 of the second embodiment is adapted to improve image recording density. To this effect, the apertures 34 are alternately positioned as shown in the sheet running direction A. Each control electrode 33 includes a circular portion 33A surrounding the aperture 34 and a linear portion 33B extending from the circular portion 33A toward the running direction A of the image receiving member P. These control electrodes 33 are provided on the downstream side in the aperture electrode body 31.

A first set of dummy electrodes 38 are positioned upstream side in the aperture electrode with respect to the sheet running direction A and in alignment with the respective aperture electrodes. Each of the first dummy electrodes 38 has a length different from each other so that the longer dummy electrode is in alignment with the shorter aperture electrode, and the shorter dummy electrode is in alignment with the longer aperture electrode. Further, a second set of dummy electrodes 68 are provided at a position laterally beside the extreme end of the control electrode 33 with a space equal to the spacing of the control electrodes 33. Moreover, the first set of dummy electrodes are also aligned with the second set of dummy electrode 68.

Similar to the first embodiment, the first set of dummy electrodes 38 will provide smooth toner supply to the apertures 34. Further, the second set of dummy electrode 68 will provide even or uniform density with respect to the array direction of the apertures 34.

While the invention has been described in detail and with reference to specific embodiments thereof, it would be apparent to those skilled in the art that various changes and modifications may be made therein without departing from the spirit and scope of the invention. For example, in the illustrated embodiment, the aperture electrode body is used as the toner flow control means. However, a mesh-like electrode body descried in a U.S. Pat. No. 5,036,341 can also be used instead of the aperture electrode body. Further, in the above embodiment, both first and second sets of dummy electrodes are provided in the substrate. However, either first or second sets of dummy electrodes can be provided in accordance with an intended purpose.

What is claimed is:

1. An image recording apparatus for forming a toner image on an image receiving medium as the image receiving medium is moved in a running direction by the image recording apparatus, said image recording apparatus comprising:

toner flow control means for controlling toner flow having an insulative substrate in which a plurality of apertures are formed and control electrodes formed on the insulative substrate and each formed around each one of the apertures;

toner transferring means for transferring toners toward the apertures;

control voltage application means for applying a predetermined controlled voltage to the control electrodes to allow the toners to pass through the apertures; and dummy electrodes provided on the toner flow control means, one dummy electrode being provided on the insulative substrate aligned with each aperture in the running direction of the image receiving medium.

2. The image recording apparatus as claimed in claim 1, wherein the plurality of apertures are arrayed in a direction perpendicular to the running direction of the image receiving medium, and the control electrodes are formed at a downstream portion in the insulative substrate with respect to the running direction, and wherein the dummy electrodes comprises a set of dummy electrodes positioned at an upstream portion in the insulative substrate with respect to the running direction.

3. The image recording apparatus as claimed in claim 2, wherein the first set of dummy electrodes are arrayed in the direction parallel with the array of the apertures.

4. The image recording apparatus as claimed in claim 3, wherein each of the control electrodes comprises a circular portion surrounding each one of the apertures and a linear portion extending from the circular portion in a direction parallel with the running direction of the image receiving member, the linear portion being positioned on the downstream portion in the insulative substrate.

5. The image recording apparatus as claimed in claim 4, wherein each of the first set of dummy electrodes is aligned with each control electrode.

6. The image recording apparatus as claimed in claim 5, wherein the insulative substrate faces with the toner transferring means.

7. The image recording apparatus as claimed in claim 6, wherein the toner transferring means comprises:

a toner case in which the toners are accumulated;

a toner supply roller rotatably disposed in the toner case; and a toner carrier roller rotatably disposed in the toner case and in contact with the toner supply roller for carrying thereon charged toners, the insulative substrate facing with the toner carrier roller.

8. The image recording apparatus as claimed in claim 7, wherein the insulative substrate is formed of a polymer material, and the control electrodes are formed of electrically conductive material, a heat expansion coefficient of the polymer material being higher than a heat expansion coefficient of the electrically conductive material.

9. The image recording apparatus as claimed in claim 1, wherein the plurality of apertures are arrayed in a direction perpendicular to a running direction of the image receiving medium, the array of the apertures including laterally extreme end apertures, and wherein the dummy electrode comprises a set of dummy electrodes positioned beside the laterally extreme end apertures.

10. The image recording apparatus as claimed in claim 9, wherein the set of dummy electrodes are spaced from the laterally extreme end apertures by a space equal to spacing of the control electrodes.

11. The image recording apparatus as claimed in claim 10, wherein the control electrodes are formed at a downstream portion in the insulative substrate with respect to the running direction, and wherein each of the control electrodes comprises a circular portion surrounding each one of the apertures and a linear portion extending from the circular portion in a direction parallel with the running direction of the image receiving member, the linear portion being positioned on the downstream portion in the insulative substrate.

12. The image recording apparatus as claimed in claim 11, wherein the insulative substrate faces with the toner transferring means.

13. The image recording apparatus as claimed in claim 12, wherein the toner transferring means comprises:

a toner case in which toners are accumulated;

a toner supply roller rotatably disposed in the toner case; and a toner carrier roller rotatably disposed in the toner case and in contact with the toner supply roller for carrying thereon charged toners, the insulative substrate facing with toner carrier roller.

14. The image recording apparatus as claimed in claim 13, wherein the insulative substrate is formed of a polymer material, and the control electrodes are formed of electrically conductive material, a heat expansion coefficient of the polymer material being higher than a heat expansion coefficient of the electrically conductive material.

15. The image recording apparatus as claimed in claim 2, wherein the array of the apertures has a laterally extreme end apertures, and wherein the dummy electrode further comprises a second set of dummy electrodes positioned beside the laterally extreme end apertures.

16. The image recording apparatus as claimed in claim 15, wherein the second set of dummy electrodes are spaced from the laterally extreme end apertures by a space equal to spacing of the control electrodes.

17. The image recording apparatus as claimed in claim 16, wherein the first set of dummy electrodes are arrayed in the direction parallel with the array of the apertures.

18. The image recording apparatus as claimed in claim 17, wherein each of the control electrodes comprises a circular portion surrounding each one of the apertures and a linear portion extending from the circular portion in a direction parallel with the running direction of the image receiving member, the linear portion being positioned on the downstream portion in the insulative substrate.

19. The image recording apparatus as claimed in claim 18, wherein each of the first set of dummy electrodes is aligned with each control electrode.

20. An image recording apparatus for forming a toner image on an image receiving medium as the image receiving medium is moved in a running direction by the image recording apparatus, the apparatus comprising:

toner flow control means for controlling toner flow having an insulative substrate in which a plurality of apertures are formed and control electrodes formed on the insulative substrate and each formed around each one of the apertures, the plurality of apertures being arrayed in a direction perpendicular to the running direction;

toner transferring means for transferring toners toward the apertures;

control voltage application means for applying a predetermined controlled voltage to the control electrodes to allow the toners to pass through the apertures; and dummy electrodes provided on the toner flow control means, the dummy electrodes being provided on the insulative substrate at positions offset from the apertures, the dummy electrodes comprising:

a first set of dummy electrodes which provide the toner flow control means with an overall heat expansion coefficient so that the toner flow control means has a continuous curvature in the running direction, said first set of dummy electrodes having one electrode aligned with each aperture in the running direction, and a second set of dummy electrodes provided at a position offset from the plurality of apertures.

21. An image recording apparatus for forming a toner image on an image receiving medium as the image receiving medium is moved in a running direction by the image recording apparatus, said image recording apparatus comprising:

toner flow control means for controlling toner flow having an insulative substrate in which control electrodes are formed and a plurality of apertures are formed, wherein said plurality of apertures are formed in a line perpendicular to the running direction and one of the control electrodes is formed around each one of the apertures;

toner transferring means for transferring toner toward the apertures;

control voltage application means for applying a predetermined controlled voltage to the control electrodes to allow the toners to pass through the apertures; and dummy electrodes provided on the toner flow control means, the dummy electrodes being provided on the insulative substrate at positions perpendicular to the running direction, each dummy electrode aligned with one of said apertures.

22. An image recording apparatus for forming a toner image on an image receiving medium as the image receiving medium is moved in a running direction by the image recording apparatus, the apparatus comprising:

toner flow control means for controlling toner flow having an insulative substrate in which control electrodes are formed and a plurality of apertures are formed, wherein said plurality of apertures are formed in a line perpendicular to the running direction and one of the control electrodes is formed around each one of the apertures;

toner transferring means for transferring toner toward the apertures;

control voltage application means for applying a predetermined controlled voltage to the control electrodes to allow the toners to pass through the apertures; and dummy electrodes provided on the toner flow control means, the dummy electrodes being provided on the insulative substrate at positions offset from the apertures, the dummy electrodes comprising:

a first set of dummy electrodes which provide the toner flow control means with an overall heat expansion coefficient so that the toner flow control means has a continuous curvature in the running direction, and a second set of dummy electrodes being provided on the insulative substrate at positions perpendicular to the running direction, each dummy electrode aligned with one of said apertures.

23. An image recording apparatus for forming a toner image on an image receiving medium as the image receiving medium is moved in a running direction by the image recording apparatus, the apparatus comprising:

toner flow control means for controlling toner flow having an insulative substrate in which control electrodes are formed and a plurality of apertures are formed, wherein said plurality of apertures are formed in a line perpendicular to the running direction and one of the control electrodes is formed around each one of the apertures;

toner transferring means for transferring toners toward the apertures;

control voltage application means for applying a predetermined controlled voltage to the control electrodes to allow the toners to pass through the apertures; and dummy electrodes provided on the toner flow control means, the dummy electrodes being provided on the insulative substrate at positions offset from the apertures, the dummy electrodes comprising:

a first set of dummy electrodes which provide the toner flow control means with an overall heat expansion coefficient so that the toner flow control means has a continuous curvature in the running direction, the first set of dummy electrodes having one electrode aligned with each aperture in the running direction, and a second set of dummy electrodes being provided on the insulative substrate at positions aligned with the plurality of apertures that are perpendicular to the running direction.

24. An image recording apparatus as claimed in claim 23, wherein a dummy electrode is provided aligned with each one of the second set of dummy electrodes in the running direction.

* * * * *